United States Patent [19]

Anzai et al.

[11] 3,990,793

[45] Nov. 9, 1976

[54] DEVELOPING STATION FOR ELECTRONIC COLOR PHOTOGRAPHING APPARATUS

[75] Inventors: Masayasu Anzai; Hiroshi Yonezawa, both of Hitachi, Japan

[73] Assignee: Hitachi, Ltd., Japan

[22] Filed: Aug. 23, 1974

[21] Appl. No.: 499,972

[30] Foreign Application Priority Data

Aug. 27, 1973 Japan ..... 48-95259

[52] U.S. Cl. ..... 355/10; 118/DIG. 23; 427/15

[51] Int. Cl.[2] ..... G03G 15/10

[58] Field of Search ..... 354/318, 319, 320, 331, 354/339; 355/10; 118/DIG. 23; 117/37 LE, 112

[56] References Cited

UNITED STATES PATENTS

| | | | |
|---|---|---|---|
| 3,155,546 | 11/1964 | Dirks | 118/DIG. 23 |
| 3,249,088 | 5/1966 | Ostensen | 118/DIG. 23 |
| 3,345,925 | 10/1967 | Ostensen | 355/10 |
| 3,416,860 | 12/1968 | Mihojevich et al. | 355/10 |
| 3,601,092 | 8/1971 | Satomi | 117/37 LE X |
| 3,651,782 | 3/1972 | MacDonald | 118/637 X |
| 3,685,907 | 8/1972 | Sato et al. | 355/10 X |
| 3,749,059 | 7/1973 | Sato | 355/10 X |
| 3,820,891 | 6/1974 | Kurakawa et al. | 355/10 |

*Primary Examiner*—Fred L. Braun
*Attorney, Agent, or Firm*—Craig & Antonelli

[57] ABSTRACT

In an electronic photographing apparatus, the offset phenomenon which tends to occur due to the conveyance of a developed photosensitive paper by a guide roller and which results in the distortion in a reproduced image is prevented by electrically insulating the toner particles fixed on the photosensitive paper from the guide roller.

6 Claims, 6 Drawing Figures

DEVELOPING STATION FOR ELECTRONIC COLOR PHOTOGRAPHING APPARATUS

BACKGROUND OF THE INVENTION

1. Field of the Invention

The present invention relates to an electronic color photographing apparatus and more particularly to a developing station which is free from the offset phenomenon that causes the distortion in the reproduced image.

2. Description of the Prior Art

As a typical way of obtaining a color picture image on the basis of electronic photography is known a method according to which a desired color image can be obtained by successively registering a desired number of primary color images each of which is monochromatically formed on a photoconductive or photosensitive medium (recording paper). This method can be practised chiefly by employing a process referred to as color electrofax (CEF). Namely, the original picture is decomposed into a plurality of primary colors and the recording paper is successively subjected to charging, exposing and developing with respect to the respective primary colors. In this case, the charging and the exposing can be performed with the recording paper kept in a non-contact condition, but in the developing process the paper must be carried by guide roller means so as to be subjected to the reaction on a developer. If the recording paper on which the toner is not completely fixed is passed between the guide rollers, the unfixed toner adheres to the rollers and then is reattached onto the recording paper (offset phenomenon) to distort the reproduced image.

SUMMARY OF THE INVENTION

One object of the present invention is to provide a developing station which can produce an image of good quality without distortion.

Another object of the present invention is to provide a developing station which is free from the offset phenomenon.

An additional object of the present invention is to provide a developing station which is used in electronic photography based on electrofax method to prevent the offset phenomenon, thereby producing a vivid color image.

According to the present invention, in a developing station in which a recording paper charged in wet condition is roller-guided, the occurrence of the offset phenomenon is prevented by keeping the toner particles on the recording paper in a non-grounded state.

DETAILED DESCRIPTION OF THE PREFERRED EMBODIMENTS

Figure 1:
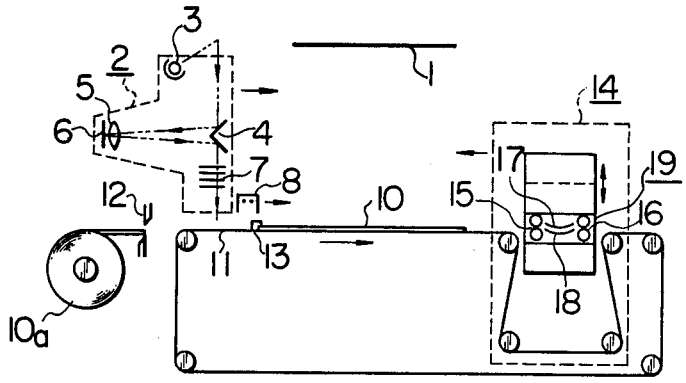
FIG. 1 schematically shows the structure of a copying apparatus based on CEF method, to which the developing station according to the present invention is applied.

A color copying apparatus based on CEF method, to which the present invention is applied, will first be described with the aid of FIG. 1. An original picture 1 is usually placed on a transparent glass plate. An optical system 2 comprises a light source 3, mirrors 4 and 6, a lens 5 and a group of filters 7, and serves to cause the light from the source 3 to be reflected from the surface of the original picture 1, to follow an optical path, i.e. the mirror 4 — the lens 5 — the mirror 6 — the lens 5 — the mirror 4— the group of filters 7 and to be imaged on a photosensitive paper 10. The optical system moves in the direction indicated by an arrow when exposure is performed. A corona charging unit 8 disposed adjacent to the optical system 2 is moved along with the system 2 so that the photosensitive paper 10 is uniformly charged. The electric charges on the photosensitive paper 10 are then released according to the original picture 1 to leave an electrostatic latent image on the photosensitive paper 10. The photosensitive paper 10 having a photoconduction property is fed from a paper roll 10*a*, cut to a desired size by a cutter 12, carried by a conveying belt 11 to a desired place (as shown in FIG. 1) and fixed in place by a fixer 13. After the above described exposing process is completed, a developing station 14 moves in the direction indicated by an arrow to guide the photosensitive paper 10 between a proximate electrode 17 and a guide plate 18 by guide rollers 15. A developing solution containing a developing toner is circulated through the space between the proximate electrode 17 and the guide plate 18 and when the photosensitive paper 10 is immersed in the developing solution, the developing toner (charged dye particles) adheres to the paper 10 in accordance with the electrostatic latent image. The developing solution on the paper 10 is then squeezed out by squeezing rollers 16. Thereafter, the developing station 14 moves opposite to the arrow and returns to the initial position as shown in the figure. In this step of returning, the squeezing rollers 16 and the guide rollers 15 exchange their roles. In this way, the process of forming an image with a first selected color is finished.

The process of forming the image with the first color is terminated at the squeezing by the rollers 15 and although the surface of the photosensitive paper 10 is wetted a second image forming process is immediately started. A plurality of developing vessels 19 each of which comprises rollers 15 and 16, a proximate electrode 17 and a guide plate 18, are placed in the developing station with one vessel superposed upon another. The number of the developing vessels is the same as that of the primary colors required for the reproduced image, as is apparent from the foregoing description. In the second image forming process, another developing vessel 19 is selected and the charging, exposing and developing are performed in the same manner as in the above described process.

A plurality of such image forming processes using desired kinds of developing solutions having a desired number of primary color dyes are represented to reproduce a color image.

Now, the offset phenomenon that occurs in the electronic copying apparatus as mentioned above will be described in detail. The offset phenomenon is usually caused as follows. When the photosensitive paper 10 with a dyeing toner thereon is passed through the guide rollers, a part of the toner adheres to the roller and the part of the toner on the roller is transferred again onto the photosensitive paper when the roller again touches the photosensitive paper. The offset phenomenon can be eliminated by increasing the adhesive force between the photosensitive paper and the toner or by subjecting the roller to cleaning. However, in the reproduction of a color picture in which a plurality of image forming processes are to be performed, the offset phenomenon will be promoted in a manner as follows. Namely, when the photosensitive paper 10 enters the developing vessel 19 after the completion of charging and exposing in one of the successive image forming processes, an offset phenomenon due to the previously formed toner image is caused by the guide rollers 15. Such an offset phenomenon occurs since the photosensitive paper is charged under a condition that the surface of the photosensitive paper is wetted (i.e. a dispersing solution exists). If the photosensitive paper with its surface wetted is charged, the charged particles lie on and in the surface of the thin film of the dispersing solution, in the boundary surface between the thin film and the photosensitive paper, and inside the photosensitive layer of the paper so that the toner image formed in the just preceding image forming process is fringed by a large amount of electric charges whose polarity is opposite to that of the charged toner, to reduce the apparent amount of the charges of the toner or to reverse the polarity of the charges. Accordingly, the attractive force between the toner and the photosensitive paper decreases until the attractive force between the toner and the charges induced in the surface of the guide roller predominates to cause the toner to be transferred to the roller. This also can be estimated from the fact that no offset phenomenon occurs.

Next, a developing station according to the present invention will be described with reference to FIGS. 2 and 3.

Figure 2:
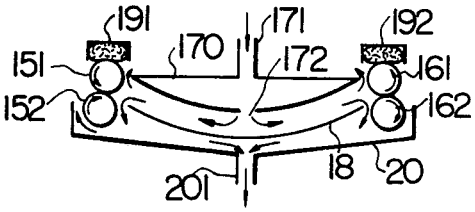
FIG. 2 is a side view of a developing station according to the present invention.
Figure 3:
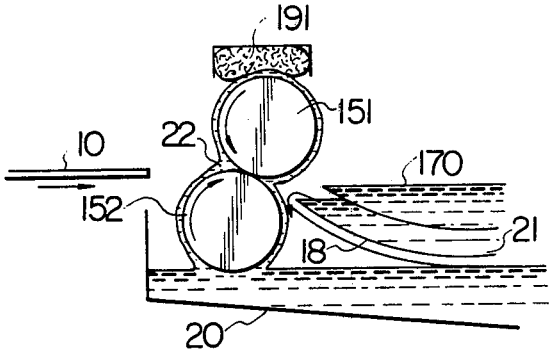
FIG. 3 shows on an enlarged scale the principal portion of the developing station shown in FIG. 2.

In FIG. 2, a reservoir or conductive tank 170 having a function of the proximate electrode is provided with an inlet port 171 and an outlet opening 172 for the developing solution. The developing solution flows, as indicated by arrows, between the tank 170 and a guide plate 18, fills another developing solution reservoir or tray 20 and at last leaves the tray 20 through an outlet port 201 thereof. The guide rollers 15 comprises a metal roller 151 and a rubber roller 152 and both the rollers are wetted by the developing solution and also they are so arranged as to retain a small amount of the solution in the recess defined on the entrance side between the rollers. A cleaning pad 191 for cleaning the metal roller 151 is sufficiently wetted by the developing solution. The squeezing rollers 16 comprises a metal roller 161 and a rubber roller 162 and another cleaning pad 192 is provided for the metal pad 161.

The operation of the developing station will now be described with the aid of FIG. 3. The developing solution 21, which has flown out of the tank 170 through the opening 172 and fills the gap between the tank 170 and the guide plate 18, flows over the brim of the guide plate 18 into the tray 20 and at the same time wets the metal roller 151 and the rubber roller 152. A part of the solution flowing over the brim of the guide plate 18 or the solution filling the tray 20 is drawn by the roller 152 as it is rotated, due to the friction with the surface of the roller 152 and forms a small pool 22 of the solution in the recess between the metal and rubber rollers 151 and 152. The part of the developing solution drawn up by the metal roller 151 wets the cleaning pad 191 and at the same time forms a thin film of the dispersing solution of the developing solution on the surface of the metal roller 151. Thus, when the photosensitive paper 10 is urged against the metal roller 151 by the rubber roller 152, as the image forming process advances, the electrical insulation between the roller 151 and the paper 10 is assured to suppress the transfer of the toner so that the offset phenomenon is prevented. Even if the toner on the paper 10 is transferred to the metal roller 151, the adhesive force of the toner is weak due to the existence of the thin film of the dispersing solution so that the transferred toner can be easily removed from the metal roller 151 by the cleaning pad 191.

Similar effects may be achieved by maintaining guide roller means itself in an insulated state instead of forming the thin film of the solution on the guide roller means as described above. In such a case, the metal roller is supported in a non-grounded state or the surface of the metal roller is coated with an insulator. In such an arrangement, however, it is necessary to prevent charges to being remarkably accumulated on the roller surface by frictional charging, transfer of charges or charing action. In order to prevent the charge accumulation, a material which is not easily friction charged may be selected or a provision for gradually leaking the accumulated charges may be made. Next, the latter example will be explained.

Figure 4:
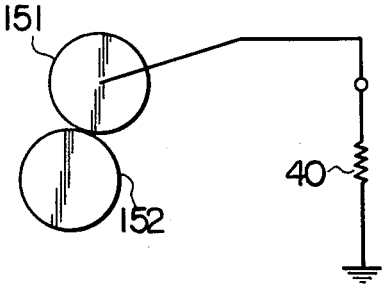
FIG. 4 is a cross section of guide rollers with their associated electrical connection, according to another embodiment of the present invention.

The electric circuit shown in FIG. 4 is effective when combined with the developing station as described above. Similar effects may be obtained even when the electric circuit is not combined with the screen developing station. As seen in the figure, the metal roller 151 is maintained in a non-grounded state and is grounded by a resistor 40. The resistor 40 serves to release the electric charges induced in the metal roller 151 due to friction etc. and has preferably a resistance value of $10^3$ to $10^{12}$ ohms.

Figure 5:
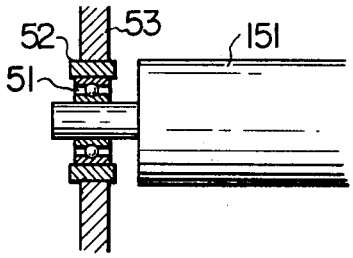
FIG. 5 is a longitudinal cross section of a roller bearing portion of another embodiment of the present invention.

FIG. 5 shows another embodiment in which the structure of a bearing for the metal roller 151 plays the same role as by the circuit shown in FIG. 4. In FIG. 5, the metal roller 151 is supported on a metal roller bearing 51 and the outer wall of the bearing 51 is attached via a resistive ring 52 to a supporting frame 53 (grounded). Preferably, the resistive ring 52 has a resistance value of $10^3$ to $10^{12}$ ohms.

Figure 6:
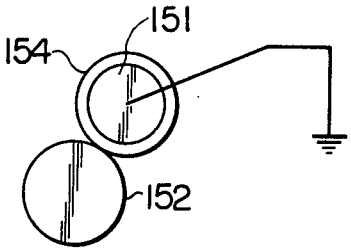
FIG. 6 is a cross section of guide rollers with their associated electrical connection, according to another embodiment of the present invention.

FIG. 6 shows another embodiment in which a coating layer 154 having a high resistance is formed on the surface of the metal layer 151 and it is preferable that the coating layer 154 should have a specific resistance of $10^3$ to $10^{12}$ ohms-cm.

In the various embodiments described above, no charge is induced in the metal roller 151 corresponding to the electrostatic latent image so that the toner particles are not attracted toward the metal roller 151. Accordingly, no offset phenomenon occurs.

We claim:

1. A developing station for electronic color photographing apparatus into which station a developing solution wetted photosensitive paper is roller-guided after charging and exposing thereof, comprising roller means including a metal roller for guiding the photosensitive paper into a developing solution, said metal roller contacting the surface of the photosensitive paper on which a color picture image is to be developed, said metal roller being supported by conductive bearings;

means for maintaining said metal roller in a non-grounded state; and a resistor of high resistance provided between said metal roller and ground, said resistor including resistive rings supporting said conductive bearings.

2. A developing station for electronic color photographing apparatus into which station a developing solution wetted photosensitive paper is roller-guided after charging and exposing thereof, comprising roller means for guiding the photosensitive paper into a developing solution, said roller means contacting the surface of the photosensitive paper on which a color picture image is to be developed, wherein said roller means include at least two guide rollers, one of said two guide rollers having a metal peripheral surface and the other of said two guide rollers having a rubber peripheral surface, and wherein said one guide roller having said metal peripheral surface contacts said surface of said photosensitive paper, means for forming a thin film of said developing solution on the surfaces of said roller means, and a reservoir of said developing solution and guide means for guiding said photosensitive paper from said two guide rollers through said reservoir, wherein said means for forming a thin film includes means for flowing said developing solution from said reservoir against said two guide rollers, wherein said means for flowing include a brim of said guide means over which brim said developing solution flows against said two guide rollers, and wherein said other guide roller having said rubber peripheral surface transports said developing solution to a recess between said two guide rollers.

3. A developing station according to claim 2, wherein said thin film of developing solution provides electrical insulation between said roller means and said photosensitive paper.

4. A developing station according to claim 2, wherein means are provided for cleaning said one guide roller having said metal peripheral surface, thereby forming said thin film.

5. A developing station for electronic color photographing apparatus into which station a developing solution wetted photosensitive paper is roller-guided after charging and exposing thereof, comprising:

roller means for guiding the photosensitive paper, said roller means including at least two guide rollers between which said photosensitive paper is sandwiched and guided, one of said two guide rollers having a metal peripheral surface contacting the surface of said photosensitive paper on which a color picture image is to be developed, the other of said two guide rollers having a rubber peripheral surface contacting the other surface of said photosensitive paper;

guide means for guiding said photosensitive paper from said roller means through a developing solution, said guide means including a guide plate on which said developing solution is supplied; and thin film forming means for forming a thin film of said developing solution on the surfaces of said roller means, said thin film forming means including a brim of said guide means over which brim said developing solution on said guide plate flows against the surface of said other guide roller having said rubber peripheral surface.

6. A developing station for electronic color photographing apparatus into which station a developing solution wetted photosensitive paper is roller-guided after charging and exposing thereof, comprising:

roller means for guiding the photosensitive paper, said roller means including at least two guide rollers between which said photosensitive paper is sandwiched and guided, one of said two guide rollers having a metal peripheral surface contacting the surface of said photosensitive paper on which a color picture image is to be developed, the other of said two guide rollers having a rubber peripheral surface contacting the other surface of said photosensitive paper;

guide means for guiding said photosensitive paper from said roller means through a developing solution, said guide means including a guide plate on which said developing is supplied; and thin film forming means for forming a thin film of said developing solution on the surfaces of said roller means, said thin film forming means including a tray for receiving therein the developing solution flowing over a brim of said guide plate to provide a level at which the surface of the developing solution in said tray contacts a portion of said rubber peripheral surface of said other guide roller so that with the rotation of said other guide roller a part of the developing solution in said tray is drawn up along said rubber peripheral surface and further fed to said metal peripheral surface of said one guide roller, thereby forming said thin film.

* * * * *